US011236590B2

(12) United States Patent
Gan et al.

(10) Patent No.: US 11,236,590 B2
(45) Date of Patent: Feb. 1, 2022

(54) DEVICE FOR JET PACKING AND FRACTURING AND TUBULAR COLUMN COMPRISING SAME

(71) Applicants: China Petroleum & Chemical Corporation, Beijing (CN); Sinopec Southwest Oil & Gas Company, Chengdu (CN)

(72) Inventors: Zhenwei Gan, Chengdu (CN); Bin Qi, Chengdu (CN); Zhimin Hou, Chengdu (CN); Shunqu Hu, Chengdu (CN); Wei Lei, Chengdu (CN); Chen Chen, Chengdu (CN); Zhi Xie, Chengdu (CN); Qiang Wang, Chengdu (CN); Wei Zhao, Chengdu (CN); Yijun Zhou, Chengdu (CN)

(73) Assignees: CHINA PETROLEUM & CHEMICAL CORPORATION, Beijing (CN); SINOPEC SOUTHWEST OIL & GAS COMPANY, Chengdu (CN)

( * ) Notice: Subject to any disclaimer, the term of this patent is extended or adjusted under 35 U.S.C. 154(b) by 845 days.

(21) Appl. No.: 16/071,143

(22) PCT Filed: Jan. 13, 2017

(86) PCT No.: PCT/CN2017/071167
§ 371 (c)(1),
(2) Date: Jul. 19, 2018

(87) PCT Pub. No.: WO2017/124979
PCT Pub. Date: Jul. 27, 2017

(65) Prior Publication Data

US 2021/0189844 A1 Jun. 24, 2021

(30) Foreign Application Priority Data

Jan. 20, 2016 (CN) ..... 201610037080.7
Jan. 20, 2016 (CN) ..... 201610037471.9

(51) Int. Cl.
*E21B 43/114* (2006.01)
*E21B 33/128* (2006.01)
*E21B 43/26* (2006.01)

(52) U.S. Cl.
CPC ..... *E21B 43/114* (2013.01); *E21B 33/1285* (2013.01); *E21B 43/26* (2013.01)

(58) Field of Classification Search
CPC ..... E21B 43/114; E21B 43/26; E21B 33/1285
See application file for complete search history.

(56) References Cited

U.S. PATENT DOCUMENTS 7,343,975 B2 * 3/2008 Surjaatmadja ..... E21B 33/127 166/297
2013/0248192 A1 * 9/2013 Cook ..... E21B 33/127 166/308.1
2015/0007994 A1 1/2015 Lancaster et al.

FOREIGN PATENT DOCUMENTS

CN 101979823 A 2/2011
CN 103742099 A 4/2014
(Continued)

OTHER PUBLICATIONS

International Search Report for International Application No. PCT/CN2017/071167, dated Apr. 12, 2017.

*Primary Examiner* — D. Andrews
(74) *Attorney, Agent, or Firm* — Finnegan Henderson Farabow Garrett & Dunner LLP

(57) ABSTRACT

A device for perforating, packing, and fracturing and a tubing string comprising the device are disclosed, wherein the device comprises an upper connector, a nozzle sleeve, a
(Continued)

mandrel, a packer, a lower connector, a first inner sleeve provided inside the upper connector, and a second inner sleeve provided inside the nozzle sleeve, further wherein the upper connector is provided with a fracturing hole, and a nozzle is provided at the nozzle sleeve.

15 Claims, 9 Drawing Sheets

(56) References Cited

FOREIGN PATENT DOCUMENTS

| | | | |
|---|---|---|---|
| CN | 204024622 | U | 12/2014 |
| CN | 204098878 | U | 1/2015 |
| CN | 105672957 | A | 6/2016 |
| CN | 105696984 | A | 6/2016 |
| CN | 106321030 | A | 1/2017 |
| WO | WO2015117224 | A1 | 8/2015 |

* cited by examiner

DEVICE FOR JET PACKING AND FRACTURING AND TUBULAR COLUMN COMPRISING SAME

This application is a national stage filing under 35 U.S.C. § 371 of International Application No. PCT/CN2017/071167, filed on Jan. 13, 2017, which claims priority of Chinese Patent Application No. CN201610037080.7, filed Jan. 20, 2016, and Chinese Patent Application No. CN201610037471.9, filed Jan. 20, 2016. The contents of these applications are each incorporated herein by reference.

CROSS REFERENCE TO RELATED APPLICATIONS

The present application claims the priority of Chinese patent application CN201610037471.9, entitled "Multi-directional pressure control tool used for perforating, packing and fracturing and tubing string comprising the tool" and filed on Jan. 20, 2016, the entirety of which is incorporated herein by reference.

The present application claims the priority of Chinese patent application CN201610037080.7, entitled "Multi-directional pressure control tool used for perforating, packing and fracturing and tubing string comprising the tool" and filed on Jan. 20, 2016, the entirety of which is incorporated herein by reference.

FIELD OF THE INVENTION

The present disclosure relates to the technical field of oil and gas well completion and reservoir stimulation, and particularly to a device for perforating, packing and fracturing and a tubing string comprising the device.

BACKGROUND OF THE INVENTION

With promotion of exploration and development of unconventional oil and gas reservoir, staged fracturing technology in well completion is developing rapidly as a main stimulation treatment during unconventional oil and gas resource production. The staged fracturing technology in well completion can perform reservoir stimulation purposefully so as to improve oil drainage area of oil and gas production layer and improve oil and gas productivity.

In the prior art, during multi-stage segmented reservoir stimulation, perforating is performed at first, and fracturing is performed later in general. That is, during reservoir stimulation, a perforating gun is run first to perform multi-stage segmented perforating so as to form a reservoir-hole in the reservoir. Then, the perforating gun is pulled out of the stratum. Next, a tubing string comprising a packer is descended, and a ball is dropped therein to pack the packer. Once again, the ball is dropped to open a first stage sliding sleeve of the packer so as to expose a first stage fracturing hole cooperating with the reservoir-hole. At last, fracturing fluid is pumped into the tubing string, and the fracturing fluid flows into the reservoir-hole through the fracturing hole to form crack in the stratum. After fracturing is finished, another larger-sized ball is dropped therein to open upper stage sliding sleeve so as to fracture a next upstream layer stratum.

With the aforesaid method, reservoir stimulation can be performed, but the tubing string needs to be run many times to perform perforating and sand fracturing. As a result, with the aforesaid method, not only operation procedures and operation costs are increased, but also fracturing accuracy and precision are decreased.

SUMMARY OF THE INVENTION

With respect to part or total of the above technical problems in the prior art, the present disclosure provides a device for perforating, packing and fracturing and a tubing string comprising the device, Using the device for perforating, packing and fracturing provided herein, the tubing string needs to be run only once to operate perforating and fracturing. Therefore, when the device for perforating, packing and fracturing is used, operation procedures and operation costs can be decreased, and fracturing accuracy and precision can be improved.

According to a first aspect, the present disclosure provides a device for perforating, packing and fracturing. The device comprises:

an upper connector, a fracturing hole for communicating inside and outside being provided in an outer wall of the upper connector;

a nozzle sleeve, which is provided at a lower end of the upper connector, a nozzle for communicating inside and outside being provided at the nozzle sleeve;

a mandrel, which is provided at a lower end of the nozzle sleeve;

a packer, which is provided on an outer wall of the nozzle sleeve and an outer wall of the mandrel, the packer comprising a rubber barrel assembly;

a lower connector, which is provided at a lower end of the mandrel;

a first inner sleeve, which is provided inside the upper connector and is slidingly connected to the upper connector, in an initial state, the first inner sleeve blocking the fracturing hole; and a second inner sleeve, which is provided inside the nozzle sleeve and is slidingly connected to the nozzle sleeve, in the initial state, the second inner sleeve blocking the nozzle, wherein after an internal flowbore of the second inner sleeve is blocked, the second inner sleeve is configured to be movable relative to the nozzle sleeve to expose the nozzle under an action of a first pressure. At the same time, the rubber barrel assembly is configured to deform under an action of a fracturing fluid so that the packer is packed. The first inner sleeve is configured to be movable relative to the upper connector to expose the fracturing hole under an action of a second pressure.

According to an embodiment, the packer further comprises:

an outer housing, with an upper end thereof being sleeve-connected fixedly to the outer wall of the nozzle sleeve and a lower end thereof extending over the mandrel;

a piston cylinder, which is formed by an upper end surface of the mandrel, an inner wall of the outer housing, and the nozzle sleeve;

a piston, with an upper end thereof being provided in the piston cylinder and a lower end thereof extending downwards between the mandrel and the outer housing and abutting against the rubber barrel assembly, the piston being slidingly connected to the outer housing; and a first pressure transmission hole, which is provided at a side wall of the nozzle sleeve, the first pressure transmission hole being in communication with the piston cylinder.

According to an embodiment, the second inner sleeve is provided with a fourth pressure transmission hole in a wall thereof, and the fourth pressure transmission hole is configured to be in communication with the first pressure transmission hole after the second inner sleeve moves downwards.

According to an embodiment, the first pressure transmission hole comprises a first part used for communicating with the fourth pressure transmission hole and a second part communicating with the first part and the piston cylinder. The first part is configured as a hole extending along a radial direction, and the second part is configured as a hole extending along an axial direction.

According to an embodiment, a reaming is provided at an inlet of the first part.

According to an embodiment, a first ratchet is provided on the outer wall of the mandrel, and a second ratchet is provided on an inner wall of the piston to cooperate with the first ratchet; and/or a third ratchet is provided on an inner wall of the nozzle sleeve, and a fourth ratchet is provided on an outer wall of the first inner sleeve to cooperate with the third ratchet.

According to an embodiment, a first stage is provided on an inner wall of the upper connector, and a second stage is provided on an outer wall of the first inner sleeve. The second stage and the first stage are arranged facing each other so that the upper connector and the first inner sleeve form a pressure cavity. A third pressure transmission hole is provided in the upper connector to communicate with the pressure cavity.

According to an embodiment, a ball seat is provided on an inner wall of the second inner sleeve. When a ball is dropped into the second inner sleeve, the ball seat is configured to cooperate with the ball so as to close the internal flowbore of the second inner sleeve.

According to an embodiment, the device further comprises an opener arranged in the second inner sleeve in a selectable manner and used for closing the internal flowbore of the second inner sleeve, the opener comprising:

an opener main body;

a resilient piece extending upwards from the opener main body;

a ball seat provided at a lower end of the opener main body; and a ball cooperating with the ball seat, wherein the resilient piece is provided with a protrusion to cooperate with a groove provided on an inner wall of the second inner sleeve.

According to an embodiment, a retaining ring is provided at a lower end of the groove of the second inner sleeve and is configured to be slidable in an axial direction relative to the second inner sleeve, and a sealing element is provided between an upper end surface of the retaining ring and the second inner sleeve so that the retaining ring compresses the sealing element during a process when the retaining ring moves upwards relative to the second inner sleeve.

According to an embodiment, an elastic booster ring is provided between the opener main body and the ball seat.

According to an embodiment, the device further comprises an unpacking retaining ring arranged at a lower end of the packer, an upper end of the unpacking retaining ring being sleeve-connected to the outer wall of the mandrel, and a lower end thereof being fixedly connected to the lower connector through a third shear pin, wherein the unpacking retaining ring, the mandrel, and the lower connector form a first space for relative movement of the unpacking retaining ring and the lower connector.

According to a second aspect, the present disclosure provides a tubing string which comprises the aforesaid device.

Compared with the prior art, the present disclosure has the following advantages. The tubing string comprising the device with this structure is descended into a reservoir, and the internal flowbore of the second inner sleeve is blocked. A fracturing fluid is pumped into the tubing string. When a pressure reaches a first pressure, the second inner sleeve moves relative to the nozzle sleeve and exposes the nozzle. At the same time, the packer is packed. Hence, a sand-carrying liquid can form a high-speed jet through the nozzle to enter the stratum, and reservoir perforation is finished. After reservoir perforation is finished, the fracturing fluid is continuously pumped into the device. When the pressure reaches a second pressure, with respect to the device for perforating, packing and fracturing in which the second inner sleeve already moves downwards, the first inner sleeve moves downwards to expose the fracturing hole. Then, the fracturing fluid is pumped into the tubing string (alternatively, the fracturing fluid can be pumped inside and outside the tubing string at the same time) to perform large displacement fracturing. With respect to the device for perforating, packing and fracturing in which the second inner sleeve does not move downwards, the first inner sleeve does not move. Thus, using the device for perforating, packing and fracturing provided herein, the tubing string needs to be descended only once to realize perforating and fracturing. Therefore, when the device for perforating, packing and fracturing is used, operation procedures and operation costs can be decreased. At the same time, during reservoir stimulation process, since after perforation is finished, fracturing is performed at a corresponding position, fracturing accuracy and precision can be ensured, and fracturing effect can be improved.

BRIEF DESCRIPTION OF THE DRAWINGS

The preferred embodiments of the present disclosure will be further illustrated hereinafter with reference to the drawings. In the drawings.

Figure 1:
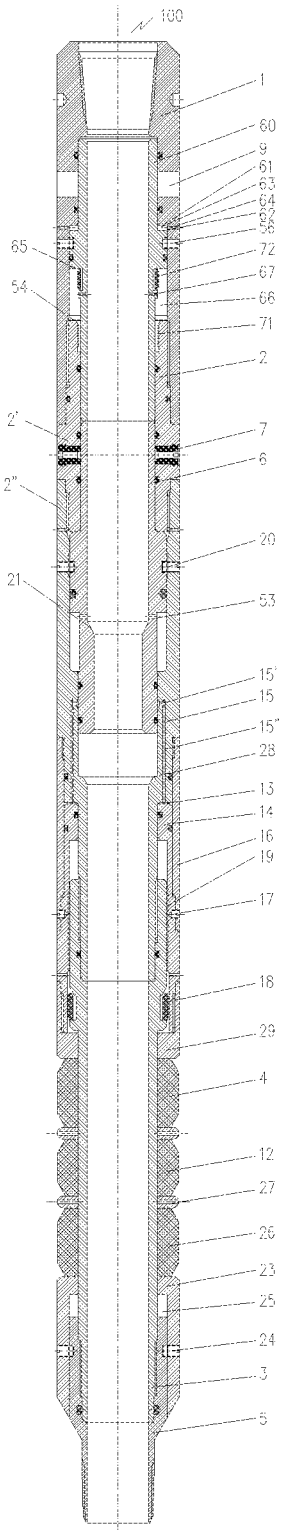
FIG. 1 schematically shows a device for perforating, packing and fracturing in an initial state according to a first embodiment of the present disclosure.

In the drawings, the same components are represented by the same reference signs, and the size of each component does not represent the actual size of the corresponding component.

DETAILED DESCRIPTION OF THE EMBODIMENTS

The present disclosure will be further illustrated hereinafter with reference to the drawings.

FIG. 1 schematically shows a device 100 for perforating, packing and fracturing in an initial state according to a first embodiment of the present disclosure. As shown in FIG. 1, the device 100 comprises an upper connector 1 having a cylindrical shape, a nozzle sleeve 2, a mandrel 3, a packer 4, a lower connector 5, a first inner sleeve 60 and a second inner sleeve 6. The upper connector 1 is configured to have the cylindrical shape and is used for connecting an oil pipe 8 so as to send the device 100 to a reservoir. A fracturing hole 9 for communicating inside and outside is provided in an outer wall of the upper connector 1. The nozzle sleeve 2 is provided at a lower end of the upper connector 1 and is configured to have a cylindrical shape. At the same time, a nozzle 7 for communicating inside and outside is provided on a circumferential wall of the nozzle sleeve 2. The mandrel 3 is provided at a lower end of the nozzle sleeve 2 and is configured to have a cylindrical shape. The packer 4 is provided on an outer wall of the lower end of the nozzle sleeve 2 and extends to an outer wall of the mandrel 3 so as to pack an annulus 11 between the device 100 and a casing pipe 10. The packer 4 comprises a rubber barrel assembly 12. The lower connector 5 is provided at a lower end of the mandrel 3 and is configured to have a cylindrical shape. The first inner sleeve 60 is provided inside the upper connector 1 and is slidingly connected to the upper connector 1. In an initial state, the first inner sleeve 60 blocks the fracturing hole 9. Under an action of a second pressure, the first inner sleeve 60 is configured to be movable downwards relative to the upper connector 1 to expose the fracturing hole 9. The second inner sleeve 6 is slidingly connected to the nozzle sleeve 2 so as to block the nozzle 7. Under an action of a first pressure, the second inner sleeve 6 moves downwards to expose the nozzle 7.

Figure 3:
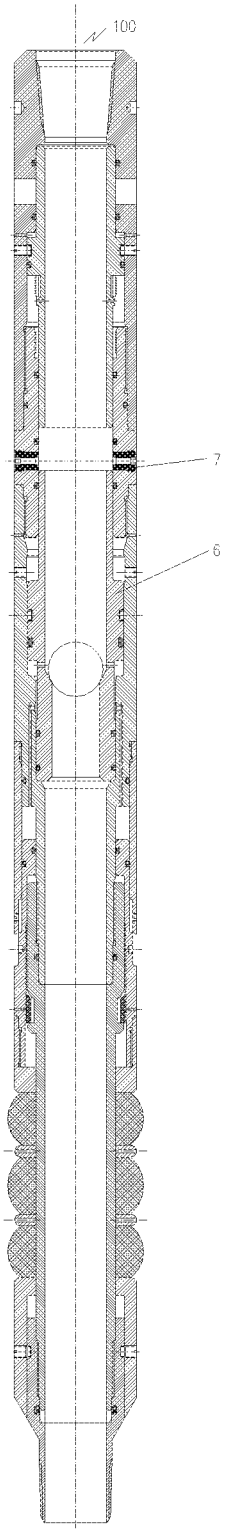
FIG. 3 schematically shows the device for perforating, packing and fracturing in a state after a second inner sleeve moves downwards according to the first embodiment of the present disclosure.
Figure 3A:
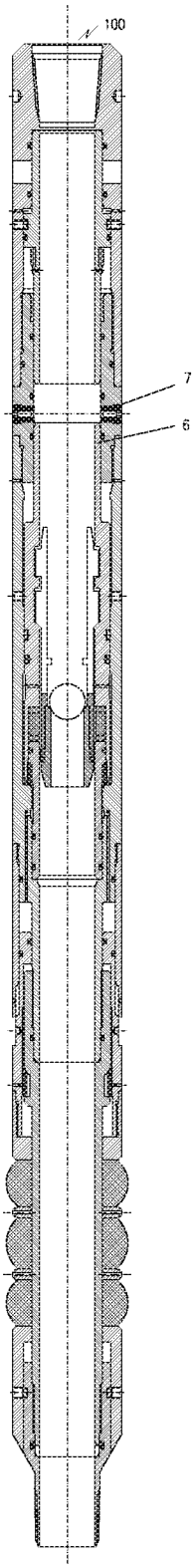
FIG. 3A schematically shows the device for perforating, packing and fracturing in a state after a second inner sleeve moves downwards according to the second embodiment of the present disclosure.
Figure 4:
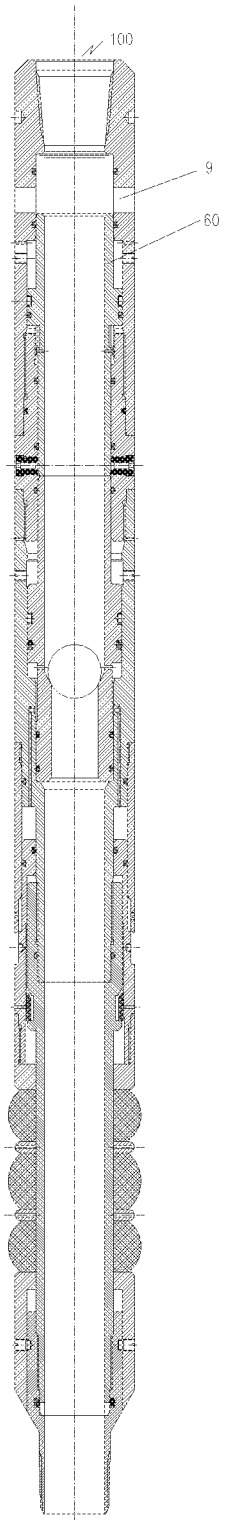
FIG. 4 schematically shows the device for perforating, packing and fracturing in a state after a first inner sleeve moves downwards according to the first embodiment of the present disclosure.
Figure 4A:
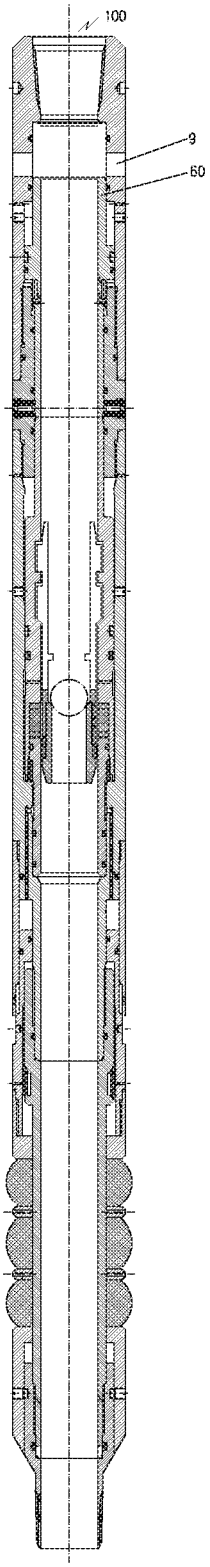
FIG. 4A schematically shows the device for perforating, packing and fracturing in a state after a first inner sleeve moves downwards according to the second embodiment of the present disclosure.

The tubing string 50 comprising the device 100 with this structure is descended into a reservoir, and an internal flowbore of the second inner sleeve 6 is blocked. A fracturing fluid is pumped into the tubing string 50. When a pressure reaches a first pressure, the second inner sleeve 6 moves relative to the nozzle sleeve 2 and exposes the nozzle 7, as shown in FIG. 3. At the same time, the rubber barrel assembly 12 is pushed so that the packer 4 is packed. A sand-carrying liquid is pumped into the second inner sleeve 6, and the sand-carrying liquid can form a high-speed jet through the nozzle 7 to enter the stratum and perform reservoir perforation. After reservoir perforation is finished, as shown in FIG. 4, the fracturing fluid is continuously pumped into the device. When the pressure reaches the second pressure, the first inner sleeve 60 moves downwards to expose the fracturing hole 9. Then, the fracturing fluid is pumped into the tubing string 50 and the annulus to perform large displacement fracturing. Thus, using the device 100 for perforating, packing and fracturing provided herein, the tubing string 50 needs to be descended only once to realize perforating and fracturing. Therefore, when the device 100 for perforating, packing and fracturing is used, operation procedures and operation costs can be decreased. At the same time, during reservoir stimulation process, since after perforation is finished, fracturing is performed at a corresponding position, fracturing accuracy and precision can be ensured, and fracturing effect can be improved.

According to the present disclosure, the packer 4 further comprises an outer housing 16, a piston cylinder 13, a piston 14, and a first pressure transmission hole 15. An upper end of the outer housing 16 is sleeve-connected fixedly to the outer wall of the nozzle sleeve 2, and the outer housing 16 extends downwards over the mandrel 3. In this manner, an upper end surface of the mandrel 3, an inner wall of the outer housing 16, and the nozzle sleeve 2 form the piston cylinder 13. An upper end of the piston 14 is provided in the piston cylinder 13 and a lower end thereof extends downwards between the mandrel 3 and the outer housing 16 and abuts against the rubber barrel assembly 12. At the same time, in an initial state, the piston 14 is connected to the outer housing 16 through a second shear pin 17. The first pressure transmission hole 15 is provided on a side wall of the nozzle sleeve 2. Besides, the first pressure transmission hole 15 is in communication with the piston cylinder 13, so that the fracturing fluid is pumped into the piston cylinder 13 through the first pressure transmission hole 15. Moreover, the first pressure transmission hole 15 is located at an upper end of an upper surface of the piston 14, so that the piston 14 can receive the fracturing fluid from the first pressure transmission hole 15. Accordingly, the second inner sleeve 6 is provided with a fourth pressure transmission hole 53 in a wall thereof. In the initial state, the first pressure transmission hole 15 is blocked by the second inner sleeve 6. During a process when the fracturing fluid is pumped, under an action of pressure, the second shear pin 17 breaks, and the second inner sleeve 6 moves downwards so that the fourth pressure transmission hole 53 is in communication with the first pressure transmission hole 15. In this manner, the fracturing fluid coming from the internal flowbore of the second inner sleeve 6 enters the piston cylinder 13 through the fourth pressure transmission hole 53 and the first pressure transmission hole 15 and pushes the piston 14 to move downwards. The piston 14 which moves downwards pushes the rubber barrel assembly 12, so that the annulus 11 is packed under an action of the rubber barrel assembly 12.

It should be noted that, after the second inner sleeve 6 moves downwards to a right position, the fourth pressure transmission hole 53 and the first pressure transmission hole 15 can be in communication with each other in a contacting manner. Of course, the fourth pressure transmission hole 53 and the first pressure transmission hole 15 can also be in communication with each other through a gap formed between the nozzle sleeve 2 and the second inner sleeve 6. In the latter case, an axial size of the second inner sleeve 6 can be relatively reduced, so that the strength of the second inner sleeve 6 can be improved, and a production cost can be reduced.

Preferably, the first pressure transmission hole 15 can comprise a first part 15' and a second part 15" communicating with the first part 15'. The first part 15' extends along a radial direction to communicate with the fourth pressure transmission hole 53. The second part 15" extends along an axial direction to communicate with the first part 15' and the piston cylinder 13 so as to provide a positive pressure to the piston 14 and push the piston 14 to move more effectively.

More preferably, an inlet (i.e., a position which communicating with the fourth pressure transmission hole 53) of the first part 15' is configured as a flaring so as to better receive the fracturing fluid supplied from the fourth pressure transmission hole 53. With this arrangement, the first pressure transmission hole 15 can receive the fracturing fluid more easily, and a precision requirement for the device 100 can be reduced.

In order to facilitate manufacturing and installation, the nozzle sleeve 2 can be configured to have a split structure. For example, as shown in FIG. 1, the nozzle sleeve 2 is configured as a first nozzle sleeve body 2' and a second nozzle sleeve body 2". The second nozzle sleeve body 2" is arranged at a lower end of the first nozzle sleeve body 2' and is fixedly connected to the first nozzle sleeve body 2'. The nozzle 7 can be arranged on an outer wall of the first nozzle sleeve body 2'. The packer 4 is connected to the second nozzle sleeve body 2", and the first pressure transmission hole 15 is arranged in a wall of the second nozzle sleeve body 2".

In order to ensure packing safety, the rubber barrel assembly 12 comprises a plurality of rubber barrels 26, and a spacer 27 is arranged between two adjacent rubber barrels 26. In another alternative case, no spacer is arranged between two adjacent rubber barrels. For example, the rubber barrel assembly 12 comprises three rubber barrels. With this arrangement, a packing effect of the packer 4 can be improved, and perforating and fracturing efficiencies of the device 100 can be ensured.

In order to ensure that a rubber barrel 26 bears a uniform force, a rod 29 is provided between the piston 14 and the rubber barrel assembly 12 to transmit the force from the piston 14 to the rubber barrel assembly 12. An upper end of the rod 29 is fixedly connected to the piston 14 a lower end thereof is connected to the mandrel 3 in a sliding manner; and a lower end surface thereof abuts against the rubber barrel 26.

In order to prevent the rubber barrel assembly 12 from returning back, a first ratchet 18 is provided on the outer wall of the mandrel 3, and a second ratchet 19 is provided on an inner wall of the piston 14. During a process when the piston 14 moves downwards, the second ratchet 19 moves downwards accordingly. After the piston 14 moves to a right position so that the rubber barrel 26 expands to pack the annulus 11, the second ratchet 19 cooperates with the first ratchet 18 to prevent the rubber barrel assembly 12 from returning back. With this arrangement, packing safety of the packer 4 can be ensured, and the following perforating and fracturing operations can be ensured.

Similarly, a third ratchet 71 is provided on an inner wall of the nozzle sleeve 2, and accordingly, a fourth ratchet 72 is provided on an outer wall of the first inner sleeve 60 to cooperate with the third ratchet 71. With this arrangement, after the first inner sleeve 60 moves downwards to expose the fracturing hole 9, the third ratchet 71 cooperates with the fourth ratchet 72 to prevent the first inner sleeve 60 from returning back.

In addition, preferably, after the first inner sleeve 60 moves downwards, a length of the first inner sleeve 60 in the axial direction is long enough so that the first inner sleeve 60 extends over the nozzle 7 and blocks the nozzle 7. That is, after perforation is finished, the nozzle 7 can be blocked by the first inner sleeve 60, and it can be ensured that the fracturing fluid is totally discharged through the fracturing hole 9. In this manner, pressure loss can be avoided, and fracturing efficiency can be improved.

According to the present disclosure, the second inner sleeve 6 is connected to the second nozzle sleeve body 2" through a first shear pin 20. Hence, during a process when the internal flowbore of the second inner sleeve 6 is blocked and the fracturing fluid is pumped therein, the first shear pin 20 breaks with the pressure increasing to a first pressure, so that the second inner sleeve 6 moves downwards to expose the nozzle 7, and the fourth pressure transmission hole 53 is in communication with the first pressure transmission hole 15. This structure is simple and easy to realize.

Figure 2:
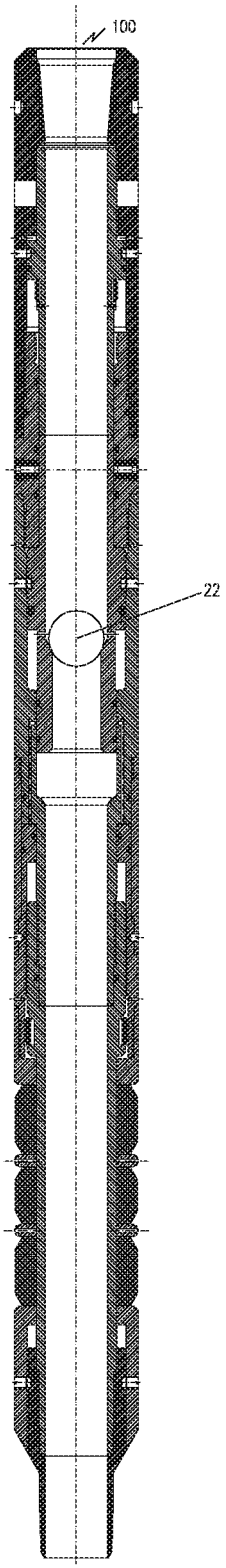
FIG. 2 schematically shows the device for perforating, packing and fracturing in a state a ball cooperating with a ball seat according to the first embodiment of the present disclosure.

According to a first preferred embodiment, a ball seat 21 is provided on an inner wall of the second inner sleeve 6. After the device 100 is descended into the stratum, a ball 22 (as shown in FIG. 2) is dropped into the second inner sleeve 6 from ground. The ball 22 and the ball seat 21 cooperate with each other to close the internal flowbore of the second inner sleeve 6. At this time, the fracturing fluid can be pumped to the device 100.

According to one preferred embodiment, the device 100 further comprises an unpacking retaining ring 23 arranged at a lower end of the packer 4. An upper end of the unpacking retaining ring 23 is sleeve-connected to the outer wall of the mandrel 3, and a lower end thereof is fixedly connected to the lower connector 5 through a third shear pin 24. At the same time, the unpacking retaining ring 23, the mandrel 3 and the lower connector 5 form a first space 25 which serves as a buffer space. In a condition when the packer 4 needs to be unpacked, the upper connector 1 can be pulled up, and the mandrel 3 and the lower connector 5 have a trend to move upwards with the upper connector 1. Since the rubber barrel 26 and the annulus 11 are in frictional contact with each other, the third shear pin 24 breaks under an action of a pulling force. After the third shear pin 24 breaks, the unpacking retaining ring 23 and the lower connector 5 move relative to each other so that the rubber barrel 26 returns back and the packer 4 is unpacked. With this arrangement, work safety of the device 100 can be improved, and the tubing string 50 can be pulled out of the casing pipe 10 in emergency situations.

According to the present disclosure, in the initial state, the first inner sleeve 60 is fixed to the upper connector 1 through a fourth shear pin 56 to block the fracturing hole 9 in the initial state. A first stage 61 is provided on an inner wall of the upper connector 1, and a second stage 62 is provided on an outer wall of the first inner sleeve 60. The first stage 61 and the second stage 62 are arranged facing each other so that the upper connector 1 and the first inner sleeve 60 form a pressure cavity 63. A third pressure transmission hole 64 is provided in a wall of the upper connector 1 to communicate with the pressure cavity 63, so that the fracturing fluid can be pumped into the pressure cavity 63 through the annulus 11 to push the first inner sleeve 60 to move downwards. Specifically, after perforation is finished, in a situation that the packer 4 is packed, the fracturing fluid is pumped into the annulus 11, and the fracturing fluid enters into the pressure cavity 63 through the third pressure transmission hole 64. Under an action of pressure, the fourth shear pin 56 breaks, and the first inner sleeve 60 is pushed to move downwards so as to expose the fracturing hole 9. At the same time, the first inner sleeve 60, after moving downwards, blocks the nozzle 7. Hence, when performing fracturing operation, the fracturing effect can be ensured.

A first inner sleeve seat 28 is arranged on an inner wall of the second nozzle sleeve body 2" to cooperate with a lower end surface of the second inner sleeve 6 so as to define a downwards moving position of the second inner sleeve 6. Preferably, the first inner sleeve seat 28 is configured as a stage on the inner wall of the second nozzle sleeve body 2". In this case, when the second inner sleeve 6 moves downwards, the lower end surface thereof recombines with the first inner sleeve seat 28 to define the downwards moving position of the second inner sleeve 6.

Similarly, an axial size of the first inner sleeve 60 and an axial size of the second inner sleeve 6 cooperate with each other to maintain a downwards moving position of the first inner sleeve 60, That is, after the first inner sleeve 60 moves downwards, a lower end surface thereof recombines with an upper end surface of the second inner sleeve 6 so as to define a position of the first inner sleeve 60. Besides, the nozzle sleeve 2 has an upper end surface 54 which extends to an internal flowbore of the upper connector 1, and a third stage 65 is configured on an outer wall of the first inner sleeve 60. Since the third stage 65 and the upper end surface 54 are arranged facing each other, a second space 66 can be formed by the first inner sleeve 60, the upper connector 1, and the nozzle sleeve 2. In order to ensure smooth downward moving of the first inner sleeve 60, a second pressure transmission hole 67 to communicate with the second space 66 is provided in a wall of the first inner sleeve 60. During a process when the first inner sleeve 60 moves downwards relative to the nozzle sleeve 2, a fluid existing in the second space 66 is discharged through the second pressure transmission hole 67 to ensure smooth downward moving of the first inner sleeve 60. Preferably, the second pressure transmission hole 67 is located at one end near the third stage 65. That is, the second pressure transmission hole 67 is located at uppermost of the second space 66.

Figure 5:
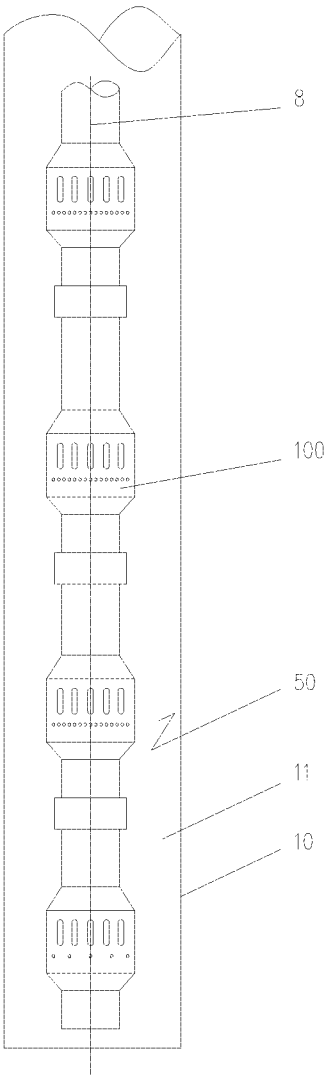
FIG. 5 schematically shows a tubing string according to an embodiment of the present disclosure.

The present disclosure further relates to a tubing string 50. The tubing string 50 comprises an oil pipe 8 and a device 100 that is fixedly connected with the oil pipe 8, as shown in FIG. 5. In order to improve reservoir stimulation scale and work efficiency, a plurality of devices 100 that are connected with each other in sequence can be provided corresponding to one tubing string 50. In order to realize blocking of the second inner sleeve 6, a diameter of the ball seat 21 of different second inner sleeves 6 of the device 100 decreases in sequence in a direction from top to bottom. In this case, after the tubing string 50 is descended into the stratum, the balls 22 with different diameters can be dropped therein to push the second inner sleeves 6 to move staged, so as to realize staged perforating and fracturing. In particular, when perforating and fracturing are performed on the present stage of stratum, since packing of the packers 4 above a target layer is not started yet, and the packers 4 of the target layer and below the target layer are already packed, the sand-carrying liquid and the fracturing fluid can only enter into the stratum through the present stage of device 100. Therefore, when the device with this structure is used, a requirement for ground pumping equipment is low. That is, in a condition that the ground pumping equipment does not change, a higher operation displacement and a better fracturing effect can be realized.

The reservoir stimulation method using the tubing string 50 comprising the device 100 will be illustrated in detail hereinafter with reference to FIGS. 1 to 5.

In a first step, the tubing string 50 which comprises the oil pipe 8 and the device 100 is descended into the casing pipe 10 to form the annulus 11 between the tubing string 50 and the casing pipe 10.

In a second step, the ball 22 is dropped into the oil pipe 8. The ball and the ball seat 21 in a corresponding stage of the second inner sleeve 6 cooperate with each other to block an inner channel of the second inner sleeve 6.

In a third step, the fracturing fluid is pumped into the oil pipe 8. The fracturing fluid is blocked by the ball seat 21 in the corresponding stage. When the pressure reaches a first pressure (for example, the first pressure is in a range from 15 MPa to 25 MPa), the first shear pin 20 breaks, and the second inner sleeve 6 moves downwards to the first inner sleeve seat 28 so as to expose the nozzle 7. Besides, the fourth pressure transmission hole 53 and the first pressure transmission hole 15 are in communication with each other. At this time, the fracturing fluid enters into the piston cylinder 13 through the fourth pressure transmission hole 53 and the first pressure transmission hole 15 to push the piston 14 to move downwards. The rod 29 acts on the rubber barrel 26, and the rubber barrel 26 expands to realize packing of the packer 4.

In a fourth step, after the packer 4 is packed, the sand-carrying liquid is pumped into the oil pipe 8. The sand-carrying liquid shoots out at a high speed by a throttle role of the nozzle 7 and enters into the stratum after passing through the casing pipe 10 to form a reservoir-hole in the stratum.

In a fifth step, after perforating is finished, the fracturing fluid is pumped into the annulus 11. The fracturing fluid enters into the pressure cavity 63 through the third pressure transmission hole 64. When the pressure reaches a second pressure (for example, the second pressure is in a range from 35 MPa to 45 MPa), the fourth shear pin 56 breaks, and the first inner sleeve 60 moves downwards to expose the fracturing hole 9. Beside, the first inner sleeve 60, after moving downwards, blocks the nozzle 7 to avoid pressure loss.

In a sixth step, the fracturing fluid is pumped into the oil pipe 8. The fracturing fluid enters into the reservoir-hole which is formed in the stratum during the perforating step through the fracturing hole 9 to perform fracturing. During this process, in order to increase the displacement and improve a fracturing effect, when the fracturing fluid is pumped into the oil pipe 8, the fracturing fluid can also be pumped into the annulus 11 at the same time to supplement the liquid.

After perforating and fracturing of the present stage of stratum are finished, the second step to the sixth step are repeated (in the second step, the ball 22 with a larger diameter is dropped into the oil pipe 8) to perform perforating and fracturing on the next stage of stratum. In this manner, multi-stage perforating and fracturing of the reservoir can be performed by one tubing string 50. Therefore, operation procedures can be reduced, and work efficiency can be improved.

In a second embodiment, an opener 40 can also be used to realize close of the internal flowbore of the inner sleeve 6 instead of dropping the ball in the first embodiment. Other structures and work principles of the device 100 in the second embodiment are roughly the same as those of the device 100 in the first embodiment. Thus, only the opener 40 and some structures cooperating with the opener 40 will be illustrated below.

Figure 1A:
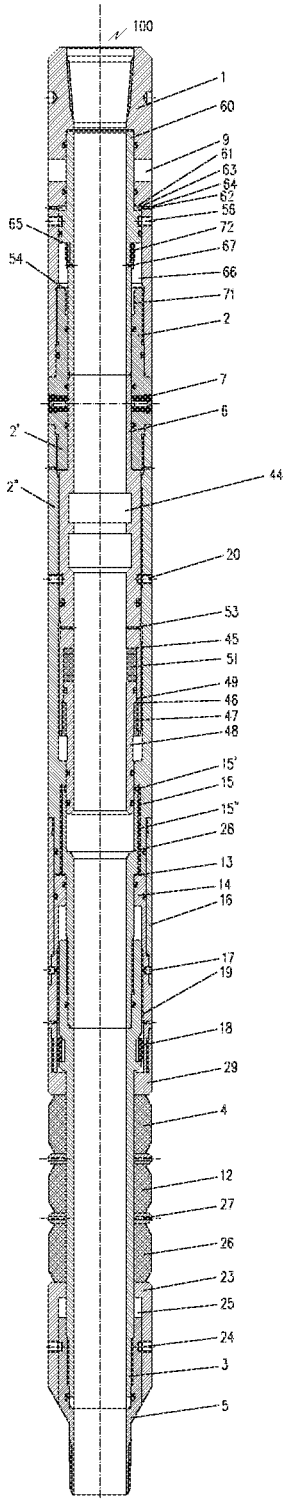
FIG. 1A schematically shows a device for perforating, packing and fracturing in an initial state according to a second embodiment of the present disclosure.
Figure 2A:
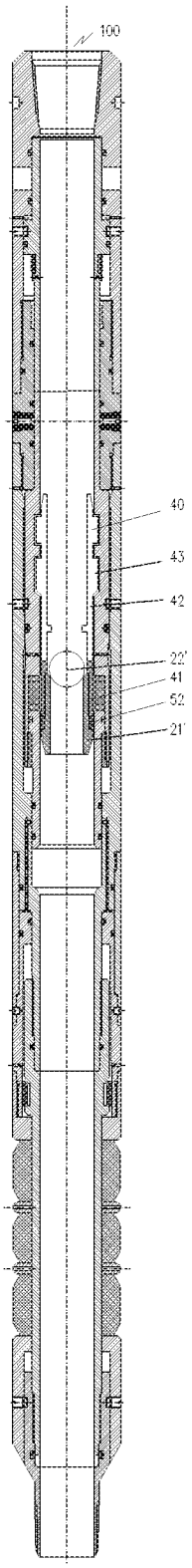
FIG. 2A schematically shows the device for perforating, packing and fracturing in a state after an opener is dropped therein according to the second embodiment of the present disclosure.

In an embodiment, as shown in FIG. 2A, the device 100 further comprises an opener 40 arranged in the second inner sleeve 6 in a selectable manner and used for closing the internal flowbore of the second inner sleeve 6. The opener 40 comprises an opener main body 41, a resilient piece 42, a ball seat 21' and a ball 22'. The opener main body 41 is configured to have a cylindrical shape and is arranged in the second inner sleeve 6. The resilient piece 42 is arranged at an upper end of the opener main body 41. Preferably, a plurality of resilient pieces 42 can be arranged and distributed in peripheral direction. The ball seat 21' is provided at a lower end of the opener main body 41 to accommodate the ball 22'. The resilient piece 42 is provided with a protrusion 43. Accordingly, the second inner sleeve 6 is provided with a groove 44 (as shown in FIG. 1A) to cooperate with the protrusion 43. During a process when the opener 40 is dropped into the second inner sleeve 6, when the opener 40 meets the second inner sleeve 6 matching it, the resilient piece 42 bounces outwards, so that the protrusion 43 and the groove 44 cooperate with each other and the opener 40 is positioned in the second inner sleeve 6. In this case, an internal circulation path of the second inner sleeve 6 is blocked, and the fracturing fluid can be pumped therein to push the second inner sleeve 6 to move downwards. With cooperation of the opener 40 having this structure and the second inner sleeve 6, the downward moving of the second inner sleeve 6 can be realized. The problems such as full-bore cannot be realized and stage limitation when the second inner sleeve 6 is pushed to move downwards by dropping a ball therein can be avoided. That is, with this arrangement, full-bore of the piple column 50 can be realized, and "countless" stage fracturing construction can be realized as well.

According to a second embodiment of the present disclosure, as shown in FIG. 1A, a first inner sleeve seat 28 is arranged on an inner wall of the nozzle sleeve 2 so as to define a downward moving position of the second inner sleeve 6. The first inner sleeve seat 28 can be configured to be a ladder platform structure. Specifically, according to the present disclosure, in a direction from top to bottom, a fourth stage 45 is arranged on an inner wall of a lower end of the groove 44 of the second inner sleeve 6. At the same time, a limiting part 47 is arranged on an inner wall of a lower end of the second inner sleeve 6. The limiting part 47 is configured to have a cylindrical shape and is fixedly connected to the second inner sleeve 6. A fifth stage 46 protruding inwards in a radial direction is formed. Accordingly, a retaining ring 48 is arranged at the lower end of the groove 44, and the retaining ring 48 is configured to have a cylindrical shape. In addition, a protruding ring 49 protruding outwards in the radial direction is arranged at an axial middle part of an outer wall of the retaining ring 48. A lower end surface of the protruding ring 49 abuts against the fifth stage 46, so that an upper end surface of the retaining ring 48 faces the fourth stage 45, and a lower end surface of the retaining ring 48 extends over a lower end surface of the second inner sleeve 6. Meanwhile, a sealing element 51 is provided between the upper end surface of the retaining ring 48 and the fourth stage 45. Preferably, the sealing element 51 can be made of rubber. The opener 40 is dropped so that the opener 40 and the second inner sleeve 6 move downwards together. After the retaining ring 48 recombines with the first inner sleeve seat 28, the second inner sleeve 6 moves downwards continuously so that the sealing element 51 expands to improve sealing performance between the second inner sleeve 6 and the opener 40. With this arrangement, the sealing performance between the second inner sleeve 6 and the opener 40 can be improved, and it can be ensured that the second inner sleeve 6 can move downwards smoothly after the fracturing fluid is pumped.

According to the present disclosure, as shown in FIG. 2A, an elastic booster ring 52 is provided in the axial direction between the opener main body 41 and the ball seat 21'. Preferably, the elastic booster ring 52 can be a rubber ring. Since the elastic booster ring 52 is arranged, a gap between the opener 40 and the oil pipe 8 and the like can be reduced. Hence, when the opener 40 is sent by adding pressure, liquid leakage can be reduced, and the opener 40 can be sent more smoothly.

According to one preferred embodiment, the device 100 further comprises an unpacking retaining ring 23 arranged at a lower end of the packer 4. An upper end of the unpacking retaining ring 23 is sleeve-connected to the outer wall of the mandrel 3, and a lower end thereof is fixedly connected to the lower connector 5 through a third shear pin 24. At the same time, the unpacking retaining ring 23, the mandrel 3 and the lower connector 5 form a first space 25 which serves as a buffer space. In a condition when the packer 4 needs to be unpacked, the upper connector 1 can be pulled up, and the mandrel 3 and the lower connector 5 have a trend to move upwards with the upper connector 1. Since the rubber barrel 26 and the annulus 11 are in frictional contact with each other, the third shear pin 24 breaks under an action of a pulling force. After the third shear pin 24 breaks, the expanded rubber barrel 26 pushes the unpacking retaining ring 23 to move downwards so as to unpack the packer 4. With this arrangement, work safety of the device 100 can be improved, and the tubing string 50 can be pulled out of the casing pipe 10 in emergency situations.

The reservoir stimulation method using the tubing string 50 comprising the device 100 will be illustrated in detail hereinafter with reference to FIGS. 1A to 4A and FIG. 5.

In a first step, the tubing string 50 which comprises the oil pipe 8 and the device 100 but does not comprise the opener 40 is descended into the casing pipe 10 to form the annulus 11 between the tubing string 50 and the casing pipe 10.

In a second step, the opener 40 is dropped into the oil pipe 8. The opener 40 cooperates with the second inner sleeve 6 in a corresponding stage to block an inner channel of the second inner sleeve 6.

In a third step, the fracturing fluid is pumped into the oil pipe 8. When the pressure reaches a first pressure (for example, the first pressure is in a range from 15 MPa to 25 MPa), the first shear pin 20 breaks, and the second inner sleeve 6 and the opener 40 move downwards to the first inner sleeve seat 28 so as to expose the nozzle 7. At this time, the fracturing fluid enters into the piston cylinder 13 through the fourth pressure transmission hole 53 and the first pressure transmission hole 15 to push the piston 14 to move downwards. The rod 29 acts on the rubber barrel 26, and the rubber barrel 26 expands to realize packing of the packer 4.

In a fourth step, after the packer 4 is packed, the sand-carrying liquid is pumped into the oil pipe 8. The sand-carrying liquid shoots out at a high speed by a throttle role of the nozzle 7 and enters into the stratum after passing through the casing pipe 10 to form a reservoir-hole in the stratum.

In a fifth step, after perforating is finished, the fracturing fluid is pumped into the annulus 11. The fracturing fluid enters into the pressure cavity 63 through the third pressure transmission hole 64. When the pressure reaches a second pressure (for example, the second pressure is in a range from 35 MPa to 45 MPa), the fourth shear pin 56 breaks, and the first inner sleeve 60 moves downwards to expose the fracturing hole 9. Beside, the first inner sleeve 60, after moving downwards, blocks the nozzle 7 to avoid pressure loss and ensure fracturing effect.

In a sixth step, the fracturing fluid is pumped into the oil pipe 8. The fracturing fluid enters into the reservoir-hole which is formed in the stratum during the perforating step through the fracturing hole 9 to perform fracturing. During this process, in order to increase the displacement and improve a fracturing effect, when the fracturing fluid is pumped into the oil pipe 8, the fracturing fluid can also be pumped into the annulus 11 at the same time to supplement the liquid.

After perforating and fracturing of the present stage of stratum are finished, the second step to the sixth step are repeated (in the second step, another opener 40 matching the second inner sleeve 6 is dropped into the oil pipe 8) to perform perforating and fracturing on the next stage of stratum. In this manner, multi-stage perforating and fracturing of the reservoir can be performed by one tubing string 50. Therefore, operation procedures can be reduced, and work efficiency can be improved.

In the present application, the directional terms such as "upper" and "lower" are used taking a case in which the device 100 is descended into the stratum as a reference.

The preferred embodiments of the present disclosure are illustrated hereinabove, but the protection scope of the present disclosure is not limited by this. Any person skilled in the art can make amendments without departing from the spirit and scope of the present disclosure. The protection scope of the present disclosure shall be determined by the scope as defined in the claims.

The invention claimed is:

1. A device for perforating, packing, and fracturing, comprising:

an upper connector, wherein a fracturing hole for communicating inside and outside is provided on an outer wall of the upper connector;

a nozzle sleeve, which is provided at a lower end of the upper connector, wherein a nozzle for communicating inside and outside is provided at the nozzle sleeve;

a mandrel, which is provided at a lower end of the nozzle sleeve;

a packer, which is provided on an outer wall of the nozzle sleeve and an outer wall of the mandrel, wherein the packer comprises a rubber barrel assembly;

a lower connector, which is provided at a lower end of the mandrel;

a first inner sleeve, which is provided inside the upper connector and is slidingly connected to the upper connector, wherein, in an initial state, the first inner sleeve blocks the fracturing hole; and a second inner sleeve, which is provided inside the nozzle sleeve and is slidingly connected to the nozzle sleeve, wherein, in the initial state, the second inner sleeve blocks the nozzle, wherein after an internal flowbore of the second inner sleeve is blocked, the second inner sleeve is configured to be movable relative to the nozzle sleeve to expose the nozzle under an action of a first pressure, at the same time, the rubber barrel assembly is configured to deform under an action of a fracturing fluid so that the packer is packed, the first inner sleeve is configured to be movable relative to the upper connector to expose the fracturing hole under an action of a second pressure.

2. The device according to claim 1, wherein the packer further comprises:

an outer housing, with an upper end thereof being sleeve-connected fixedly to the outer wall of the nozzle sleeve and a lower end thereof extending over the mandrel;

a piston cylinder, which is formed by an upper end surface of the mandrel, an inner wall of the outer housing, and the nozzle sleeve;

a piston, with an upper end thereof being provided inside the piston cylinder and a lower end thereof extending downwards between the mandrel and the outer housing and abutting against the rubber barrel assembly, wherein the piston is slidingly connected to the outer housing; and a first pressure transmission hole, which is provided at a side wall of the nozzle sleeve, wherein the first pressure transmission hole is in communication with the piston cylinder.

3. The device according to claim 2, wherein the second inner sleeve is provided with a fourth pressure transmission hole on a wall thereof, and the fourth pressure transmission hole is configured to be in communication with the first pressure transmission hole after the second inner sleeve moves downwards.

4. The device according to claim 3, wherein the first pressure transmission hole comprises a first part for communicating with the fourth pressure transmission hole and a second part communicating with the first part and the piston cylinder; and wherein the first part is configured as a hole extending along a radial direction, and the second part is configured as a hole extending along an axial direction.

5. The device according to claim 4, wherein a reaming is provided at an inlet of the first part.

6. The device according to claim 2, wherein a first ratchet is provided on the outer wall of the mandrel, and a second ratchet is provided on an inner wall of the piston to cooperate with the first ratchet.

7. The device according to claim 6, wherein a third ratchet is provided on an inner wall of the nozzle sleeve, and a fourth ratchet is provided on an outer wall of the first inner sleeve to cooperate with the third ratchet.

8. The device according to claim 2, wherein a first stage is provided on an inner wall of the upper connector, and a second stage is provided on an outer wall of the first inner sleeve, wherein the second stage and the first stage are arranged opposite to each other so that the upper connector and the first inner sleeve form a pressure cavity, and a third pressure transmission hole is provided in the upper connector to communicate with the pressure cavity.

9. The device according to claim 2, wherein a third ratchet is provided on an inner wall of the nozzle sleeve, and a fourth ratchet is provided on an outer wall of the first inner sleeve to cooperate with the third ratchet.

10. The device according to claim 1, wherein a ball seat is provided on an inner wall of the second inner sleeve, wherein when a ball is dropped into the second inner sleeve, the ball seat is configured to cooperate with the ball so as to close the internal flowbore of the second inner sleeve.

11. The device according to claim 1, further comprising an opener arranged in the second inner sleeve in a selectable manner and used for closing the internal flowbore of the second inner sleeve, wherein the opener comprises:

an opener main body;

a resilient piece extending upwards from the opener main body;

a ball seat provided at a lower end of the opener main body; and a ball cooperating with the ball seat, wherein the resilient piece is provided with a protrusion to cooperate with a groove provided on an inner wall of the second inner sleeve.

12. The device according to claim 11, wherein a retaining ring is provided at a lower end of the groove of the second inner sleeve and is configured to be slidable in an axial direction relative to the second inner sleeve, and a sealing element is provided between an upper end surface of the retaining ring and the second inner sleeve so that the retaining ring compresses the sealing element during a process when the retaining ring moves upwards relative to the second inner sleeve.

13. The device according to claim 11, wherein an elastic booster ring is provided between the opener main body and the ball seat.

14. The device according to claim 1, further comprising an unpacking retaining ring arranged at a lower end of the packer, wherein an upper end of the unpacking retaining ring is sleeve-connected to the outer wall of the mandrel, and a lower end thereof is fixedly connected to the lower connector through a third shear pin, wherein the unpacking retaining ring, the mandrel, and the lower connector form a first space for relative movement of the unpacking retaining ring and the lower connector.

15. A tubing string, comprising the device according to claim 1.

* * * * *